US009248496B2

(12) United States Patent
Huber et al.

(10) Patent No.: US 9,248,496 B2
(45) Date of Patent: Feb. 2, 2016

(54) DIE CAST PART OF A DIE CASTING MOLD AND CORRESPONDING DIE CASTING DEVICE

(75) Inventors: Ignaz Huber, Train-St. Johann (DE); Johannes Wunder, Hohenbrunn (DE); Michael Guenzel, Olching (DE); Sebastien Nissle, Plochingen (DE)

(73) Assignees: Georg Fischer Automotive (Suzhou) Co Ltd, Suzhou (CN); Georg Fischer GmbH & Co KG, St. Gallen (AT); Georg Fischer Druckguss GmbH & Co KG, Herzogenburg (AT); Georg Fischer GmbH, Werdohl (DE)

( * ) Notice: Subject to any disclaimer, the term of this patent is extended or adjusted under 35 U.S.C. 154(b) by 0 days.

(21) Appl. No.: 13/698,386

(22) PCT Filed: May 4, 2011

(86) PCT No.: PCT/EP2011/057123

§ 371 (c)(1),
(2), (4) Date: Mar. 5, 2013

(87) PCT Pub. No.: WO2011/144448

PCT Pub. Date: Nov. 24, 2011

(65) Prior Publication Data

US 2013/0153168 A1 Jun. 20, 2013

(30) Foreign Application Priority Data

May 18, 2010 (EP) ..... 10163119

(51) Int. Cl.
*B22D 17/20* (2006.01)
*B22D 17/22* (2006.01)

(52) U.S. Cl.
CPC ..... *B22D 17/20* (2013.01); *B22D 17/2218* (2013.01)

(58) Field of Classification Search
CPC ..... B22D 17/20; B22D 17/22; B22D 17/2218
USPC ..... 164/47, 271, 312, 122, 125–128, 371, 164/443–444, 348
See application file for complete search history.

(56) References Cited

U.S. PATENT DOCUMENTS 4,583,579 A * 4/1986 Miki et al. ..... 164/457
4,886,107 A * 12/1989 Zecman ..... 164/113

(Continued)

FOREIGN PATENT DOCUMENTS

DE 3502895 A1 8/1985
DE 102006008359 A1 8/2007

(Continued)

OTHER PUBLICATIONS

English machine translation of DE102007054723A1.*

*Primary Examiner* — Kevin P Kerns
*Assistant Examiner* — Steven Ha
(74) *Attorney, Agent, or Firm* — Bachman & LaPointe, P.C.

(57) ABSTRACT

The invention relates to a die cast part (8, 9, 10, 11, 12) of a die casting mold (5, 6, 7), having at least one first component (13, 15, 17, 19, 21) comprising a pressure zone (24, 25, 40, 60), at least one second component (14, 16, 18, 20, 22) and at least one heat exchange chamber (27, 36, 43, 51, 55, 62) permeated by a fluid and formed by the components (13, 14, 15, 16, 17, 18, 19, 20, 21, 22) for controlling the temperature of the pressure zone (24, 25, 40, 60), wherein the first component (13, 15, 17, 19, 21) comprises a heat transfer surface (34, 41, 61) integral to at least one wall of the heat exchange chamber (27, 36, 43, 51, 55, 62) and thermally associated with the pressure zone (24, 25, 40, 60). The second component (14, 16, 18, 20, 22) comprises at least one fluid guiding protrusion (64) protruding into the heat transfer chamber (27, 36, 43, 51, 55, 62) and/or a fluid guiding recess (26, 49) open toward the first component (13, 15, 17, 19, 21), wherein the fluid guiding recess (26, 49) forms at least one portion of the heat exchange chamber (27, 36, 43, 51, 55, 62) and/or the fluid guiding protrusion (64) and/or the fluid guiding recess (24, 49) form or forms a flow contour surface (65) of the second component (14, 16, 18, 20, 22) in particular adapted to the curve of the heat transfer surface (34, 41, 61). The invention further relates to a die casting device (1).

27 Claims, 8 Drawing Sheets

(56) References Cited

U.S. PATENT DOCUMENTS

| | | | | |
|---|---|---|---|---|
| 5,363,899 | A * | 11/1994 | Takagi et al. | 164/4.1 |
| 5,524,701 | A * | 6/1996 | Freeman | 164/149 |
| 5,711,363 | A * | 1/1998 | Scruggs et al. | 164/113 |
| 2004/0194905 | A1 * | 10/2004 | Ulerick | 164/134 |
| 2005/0274483 | A1 * | 12/2005 | Dubay | 164/312 |

FOREIGN PATENT DOCUMENTS

| | | | |
|---|---|---|---|
| DE | 102007054723 | A1 * | 5/2009 |
| JP | 2007061867 | A | 3/2007 |

* cited by examiner

DIE CAST PART OF A DIE CASTING MOLD AND CORRESPONDING DIE CASTING DEVICE

BACKGROUND OF THE INVENTION

The invention relates to a die casting mold part of a die casting mold, having at least one first component comprising a pressure zone, at least one second component and at least one heat exchange chamber which is formed by the components and through which a fluid can flow, for controlling the temperature of the pressure zone, the first component having a heat transfer surface which belongs to at least one wall of the heat exchange chamber and is thermally associated with the pressure zone. The invention furthermore relates to a die casting device.

Such die casting molds are used, for example, for die casting devices for die casting. Die casting is preferably used for the casting of metals, in particular nonferrous metals or special materials. In die casting, the molten casting material, i.e. the melt, is pressed under high pressure with a relatively large speed into a casting mold—also referred to as a mold insert. Melt flow rates of from 20 to 160 m/s and short shot times of from 10 to 100 ms for introduction are achieved in this case. The casting mold, or die casting mold, consists for example of metal, preferably a hot working steel. For die casting, distinction may be made between the hot chamber method and the cold chamber method. In the former, the die casting device and a furnace for keeping the melt hot form a unit. The casting apparatus, which delivers the melt to the casting mold, lies in the melt; in each casting process, a particular volume of the melt is pressed into the casting mold. In the cold chamber method, conversely, the die casting device and the furnace for keeping the melt hot are arranged separately. Only the amount required for the respective casting is dosed into a casting chamber and introduced from there into the casting mold.

The die casting mold consists of at least one die casting mold part, which comprises the first component and the second component. The first component comprises a cavity which constitutes the heat exchange chamber. The cavity, or heat exchange chamber, is closed by means of the second component, which is formed in the shape of a plate, so as to keep a fluid used for cooling the die casting mold part in the heat exchange chamber. The fluid can therefore only be introduced into the heat exchange chamber through an inlet, or an inlet valve, and discharged from the heat exchange chamber through an outlet, or an outlet valve.

The first component comprises the pressure zone, to which pressure is applied by the melt when carrying out the casting process. In this case, the pressure zone is part of a wall of the heat exchange chamber. Preferably, the heat transfer surface which is thermally associated with the pressure zone belongs to the same wall. This means that heat can be transferred between the pressure zone and the heat transfer surface, and the pressure zone is consequently associated in terms of heat transfer with the heat transfer surface. The second component is preferably provided lying away from the pressure zone.

A similar structure is known, for example, from DE 35 02 895 A1. In the case of the die casting mold described in DE 35 02 895 A1, however, the problem arises that reliable and uniform temperature control of the pressure zone is not achievable. For this reason, cooling of the die casting mold part must be dimensioned in such a way that reliable cooling is provided and, at the same time, the cooling of a die-cast component to be produced is not compromised by excessively rapid and/or nonuniform cooling. The constraints of sufficient cooling of the die casting mold part and maximally uniform cooling of the die-cast component lead to comparatively low cycle times in the production of the die-cast component, so as to achieve good durability of the die-cast component in this manner. This, however, means that only a comparatively small number of die-cast components can be produced per unit time.

In relation to this, it is an object of the invention to provide a die casting mold part which does not present the disadvantages mentioned in the introduction, but simultaneously permits a good cooling characteristic and a high throughput (die-cast components per unit time).

SUMMARY OF THE INVENTION

The foregoing object is achieved according to the invention by a die casting mold part. In this case, the second component comprises at least one fluid guide projection extending into the heat exchange chamber and/or a fluid guide recess which is open in the direction of the first component, the fluid guide recess forming at least one part of the heat exchange chamber and/or the fluid guide projection and/or the fluid guide recess forming a flow contour surface, in particular adapted to the profile of the heat transfer surface, of the second component. Thus, the second component is firstly intended to comprise the fluid guide projection or the fluid guide recess. Both the fluid guide projection and the fluid guide recess face in the direction of the first component. This means that the fluid guide projection extends into the heat exchange chamber and the fluid guide recess is formed to be open in the direction of the first component. The fluid guide recess is in this case intended to form at least one part of the heat exchange chamber, so that fluid which is used for controlling the temperature of the pressure zone, or the heat transfer surface, can flow through the fluid guide recess.

By introducing the fluid, adjusted to a particular temperature, into the heat exchange chamber, the temperature of the pressure zone can be adjusted at least approximately in a controlling and/or regulating manner. To this end at least one temperature sensor, with which the temperature of the pressure zone can be determined at least approximately, may be provided on or in the die casting mold part. On the basis of this determined temperature, the temperature and/or throughput (volume or mass per unit time) of the fluid can subsequently be selected, or adjusted. The fluid flows through the heat exchange chamber while flowing over the heat transfer surface. Because the latter is associated thermally, or in terms of heat transfer, with the pressure zone, temperature control of the pressure zone is thereby carried out.

Usually, the temperature of the fluid is in this case much lower than the temperature of the pressure zone, or of the die casting mold part, so that the die-cast component to be produced cools, and can be removed from the die casting device, as rapidly as possible. In contrast to the die casting mold parts known from the prior art, in this case the heat exchange chamber is accordingly formed at least partially in the second component, which permits improved application of the fluid to the heat transfer surface and consequently an improved cooling characteristic, i.e. more rapid cooling of the die casting mold part.

As an alternative or in addition, the fluid guide projection and/or the fluid guide recess form the flow contour surface. The latter is provided on the second component. A flow contour surface is in this case intended to mean a non-planar surface contour. With the contouring of the second component provided in this way, the flow of the fluid onto the heat transfer surface can be improved, or the fluid can be applied in a controlled way to regions of the heat transfer surface. The better cooling characteristic, i.e. the more rapid cooling, can also be achieved in this way. Preferably, the flow contour surface is in this case intended to be adapted to the profile of the heat transfer surface. For example, the flow contour surface and the heat transfer surface may extend parallel to one another at least locally. In this way, the fluid is guided in such a way that the fluid can be applied in a controlled way to regions of the heat transfer surface.

For example, this is provided for regions of the heat transfer surface which correspond to regions of the pressure zone which are thermally loaded particularly heavily. As an alternative, merely the heat transfer surface, or the heat transfer surface and the second component, may also have contouring. Preferably, the heat transfer surface and/or the second component are contoured in such a way that maximally uniform cooling of the die-cast component to be produced is achieved. In this way, stresses in the material of the die-cast component are avoided and a high stability is thus achieved.

At this point, it should expressly be mentioned that the die casting mold part may be used both for the hot chamber method and for the cold chamber method, and for arbitrary material compositions of the melt.

According to a refinement of the invention, the fluid guide recess forms the heat exchange chamber at least for the most part, and in particular completely. It may accordingly be provided that, besides the fluid guide recess, a further recess is present, for example in the first component, which forms the heat exchange chamber together with the fluid guide recess. In this case, however, the volume of the fluid guide recess is intended to be greater than the volume of the further recess. It is particularly advantageous for the heat exchange chamber to be formed exclusively by the fluid guide recess, i.e. no further recess is provided.

According to a preferred refinement, the fluid guide recess is formed in the manner of a trough in the second component. The fluid guide recess is accordingly a recess which is enclosed by the second component in such a way that an opening is merely provided so that the fluid guide recess is open in the direction of the first component. In particular, the fluid guide recess is intended to be at least laterally delimited by the second component. In such an embodiment, for example, a third component connected or connectable to the second component—for example by means of a screw connection—may form the bottom of the fluid guide recess.

According to another configuration of the invention, the first component is formed in the manner of a lid or flatly. In this case, "in the manner of a lid" is intended to mean a configuration of the first component in which—as seen in cross section—it extends further toward the second component in its edge regions than in a central region. This may, for example, be achieved by curvature of the first component or by providing an edge web. As an alternative, however, the first component may also be formed flatly, in which case it has a planar profile as seen in cross section and a distance from the second component is thus essentially constant.

According to a refinement of the invention, a recess of the first component at least locally forms the heat exchange chamber. Such an embodiment has already been indicated above. The heat exchange chamber may be formed fully by the recess of the first component, in which case the fluid guide projection of the second component extends into the recess. As an alternative, both the recess of the first component and the fluid guide recess of the second component may be provided, and together form the heat exchange chamber. Preferably, the volume of the fluid guide recess is in this case greater than that of the recess.

According to an advantageous refinement, the flow contour surface comprises at least one convex and/or concave region jointly formed by the fluid guide projection and/or the fluid guide recess. The flow contour surface may in principle be arbitrarily shaped. Preferably, however, it comprises convexly or concavely formed regions in which the flow contour surface extends continuously, i.e. has no jumps or shoulders. If a plurality of convex and/or concave regions are provided, then the transition between these preferably extends continuously. By the continuous flow contour surface, the heat exchange chamber can be configured favorably in terms of flow, i.e. the fluid flowing through it can experience a comparatively low flow resistance. Furthermore, the occurrence of vortices and/or backward flows is reduced, so that reliable flow of the fluid over the heat transfer surface is provided.

The convex or concave regions may in this case be at least jointly formed by the fluid guide projection and/or the fluid guide recess. This accordingly means that the fluid guide projection or the fluid guide recess at least locally comprises a convexly and/or concavely extending surface. The fluid guide projection or the fluid guide recess may thus also be used as so-called turbulators, so as to increase the heat transfer from the heat transfer surface to the fluid.

According to another configuration of the invention, the contour of the heat transfer surface at least locally is approximated to an in particular three-dimensional contour of the pressure zone or corresponds thereto. This may, for example, be achieved by a uniform wall thickness of the wall which is associated with both the pressure zone and the heat transfer surface on respectively opposite sides. As an alternative, however, by means of a corresponding selection of the wall thickness, a desired thermal conduction rate therein may be achieved, or adjusted in a controlled way for particular regions. For example, it may be provided that the wall thickness of the wall decreases in the flow direction of the fluid, since the fluid is heated while flowing through and its cooling effect on the heat transfer surface or the pressure zone therefore decreases. In order to compensate for this, it may be necessary to increase the thermal conductivity of the wall, which is usually achievable by a smaller wall thickness.

In a preferred configuration, the flow contour surface extends with respect to the heat transfer surface in such a way that there is at least zonally an approximately consistently large flow cross section for the fluid through the flow path of the fluid lying in the heat exchange chamber. Accordingly, the flow contour surface at least locally extends substantially parallel to the heat transfer surface. The consistently large flow cross section for the fluid is thus achieved. Such a configuration has the advantage of reducing the occurrence of vortices and/or backward flows, which preferentially occur in regions in which the flow cross section for the fluid changes too greatly, or too rapidly.

According to a refinement of the invention, the heat exchange chamber is fluidically connected to at least one fluid connection, formed in particular as a fluid line. In order to supply fluid to the heat exchange chamber and/or discharge fluid therefrom, the fluid connection to which the heat exchange chamber is fluidically connected is provided. Preferably, two fluid connections are associated with the heat exchange chamber, in which case the fluid can be supplied to the heat exchange chamber through one of the fluid connections and discharged from the heat exchange chamber through the other. The fluid connections may in this case be formed at least locally as a fluid line—for example formed in a similar way to a pipeline.

According to an advantageous configuration of the invention, the fluid line is at least locally provided in the first component and/or the second component. The fluid line accordingly extends partially through the first and/or second components. For example, the fluid line is provided as a bore and accordingly forms a fluid supply bore or a fluid discharge bore. If a plurality of fluid connections, or fluid lines, open into the heat exchange chamber, then they are preferably arranged significantly separated from one another, in particular when fluid is supplied to the heat exchange chamber by means of one of the fluid connections and fluid is removed by means of the other fluid connection. In this case, an arrangement of the openings of fluid connections or fluid lines on the heat exchanger on—as seen in the flow direction—opposite sides thereof is preferred.

According to another configuration of the invention, the first component or the second component comprises a compartment into which the second component or the first component can be inserted at least locally, in particular fully. Besides inserting the first or second component into the compartment, the former is preferably engaged by the other respective component in such a way that it is fixed at least in the lateral direction, i.e. no slipping of the one component relative to the other component is possible in this direction. In order to support the one component in the vertical direction, a bearing surface may be provided on the other component in the region of the compartment. This bearing surface is preferably formed as a bearing web which extends around further regions of the compartment in an outer region of the compartment. The bearing surface may in this case cooperate with a mating surface of the one component in order to achieve a sealing effect between the one component and the other.

According to a refinement of the invention, the pressure zone of the first component delimits at least a part of a casting mold for a die-cast component, of a casting delivery region and/or of a casting inlet. The casting mold is provided in order to form the die-cast component. During the casting process, the melt is thus introduced into it and the die-cast component is subsequently removed from it. The die casting mold essentially replicates at least one region of the die-cast component in negative. The pressure zone is then provided in order to delimit the casting mold at least locally. The melt is accordingly applied directly to the pressure zone when the casting process is being carried out, so that the latter is exposed to both high temperatures and strong temperature changes. As an alternative or in addition, it is of course also possible to provide that the pressure zone of the first component delimits the casting delivery region or the casting inlet. The latter is often also referred to as a casting die or as a mating die.

According to a preferred refinement, a pressure region of the second component jointly delimits the casting mold, the casting delivery region and/or the casting inlet. Besides the pressure zone of the first component, the pressure region of the second component is thus also provided adjacent to the casting mold, so that the pressure zone and the pressure region together delimit the casting mold at least locally. It is thus possible to provide that the melt is applied to both the first component and the second component during the casting process. As an alternative or in addition, it is likewise possible to provide that the pressure region of the second component delimits the casting delivery region or the casting inlet.

According to an advantageous configuration of the invention, the heat exchange chamber is adapted in its shape to the profile of at least one flow channel associated with the casting mold, the casting delivery region and/or the casting inlet. The shape is therefore adapted in particular to the circumferential contour of the pressure zone, in which particularly good or uniform cooling is intended to be achieved. The heat exchange chamber may for example comprise, in the region of the heat transfer surface, at least one convexity which is thermally associated with the flow channel or the corresponding region of the casting mold, of the casting delivery region and/or of the casting inlet. This applies particularly in plan view, so that from this perspective there may for example be a coast-like profile having at least one convexity or concavity. In this way, an outstanding cooling effect, or cooling characteristic, can also be achieved in the region of the flow channel.

According to a refinement of the invention, the first component is releasably connected to the second component, in particular by means of a screw connection. It is provided that the first component is formed separately from the second component. The at least two components are subsequently assembled to form the die casting mold part while being releasably connected to one another, so that the heat exchange chamber is formed. The releasable connection may in principle be produced arbitrarily. A screw connection having at least one screw or a threaded bolt is, however, preferred.

According to a refinement of the invention, the first and/or the second component comprises at least one sensor compartment for a temperature sensor. The temperature sensor is used to determine the temperature of the first or second component, at least approximately. With the aid of the determined temperature, temperature control of the fluid, or adjustment of a fluid throughput, can be carried out in a controlling and/or regulating manner. Preferably, the sensor compartment is arranged in such a way that the temperature sensor can at least approximately record the temperature of the pressure zone or of the pressure region of the first or second component, respectively.

According to another configuration of the invention, a seal sealing the heat exchange chamber is provided between the first component and the second component. In order to prevent unintended emergence of the fluid from the heat exchange chamber, the seal is associated therewith. The seal may, for example, be configured as an O-ring and essentially engage the heat exchange chamber in the circumferential direction. Replacement of the fluid contained in the heat exchange chamber is of course still possible by means of the fluid connection, or the fluid line.

The invention furthermore relates to a die casting device having at least one die casting mold part, in particular according to the embodiments above, the die casting mold part being part of a die casting mold and having at least one first component comprising a pressure zone, at least one second component and at least one heat exchange chamber which is formed by the components and through which a fluid can flow, for controlling the temperature of the pressure zone, the first component having a heat transfer surface which belongs to at least one wall of the heat exchange chamber and is thermally associated with the pressure zone. In this case, the second component comprises at least one fluid guide projection extending into the heat exchange chamber and/or a fluid guide recess which is open in the direction of the first component, the fluid guide recess forming at least one part of the heat exchange chamber and/or the fluid guide projection and/or the fluid guide recess forming a flow contour surface, in particular adapted to the profile of the heat transfer surface, of the second component. The die casting device is for example a die casting machine, and is accordingly formed in order to produce die-cast components. Besides further generally known elements, it comprises at least one die casting mold part, which is formed or refined according to the embodiments above.

According to an advantageous configuration of the invention, at least one die casting mold respectively forms a casting mold unit, a casting delivery unit and/or a casting inlet unit of the die casting device, the casting mold unit comprising a casting mold, the casting delivery unit comprising a casting delivery region and the casting inlet unit comprising a casting inlet. In this case, the casting mold, the casting delivery region and the casting inlet are respectively delimited at least locally by the pressure zones of the first components of the die casting mold part of the die casting mold. In the casting mold unit, the casting mold is provided, into which the melt is introduced and from which the die-cast component can subsequently be removed. The melt is supplied via the casting delivery unit and/or the casting inlet. Usually, the casting mold unit and the casting delivery unit consist of at least two die casting mold parts, while the casting inlet unit comprises merely one die casting mold part.

According to a refinement of the invention, the casting mold, the casting delivery region and/or the casting inlet are fluidically connected to one another in order for a casting material to flow through. The fluid, or molten, casting material is also referred to as a melt. As already established above, the casting material is supplied to the casting mold via the casting delivery region or the casting inlet. Accordingly, there must be fluidic connection between the casting mold and the casting delivery region, or the casting inlet. The casting mold, the casting delivery region and the casting inlet therefore constitute casting regions through which the melt, or the casting material, can flow.

According to a refinement of the invention, the heat exchange chambers of the casting mold unit, of the casting delivery unit and/or of the casting inlet unit are fluidically connected to one another in order for the fluid to flow through in particular by means of at least one passage or at least one line. Both the casting mold unit and the casting delivery unit, as well as the casting inlet unit, may respectively consist of a die casting mold which, in its turn, comprises at least two die casting mold parts. The casting mold unit, and the casting delivery unit or the casting inlet unit, therefore respectively comprise at least one heat exchange chamber. These heat exchange chambers are intended to be connected to one another in such a way that the fluid can flow through them in common.

In this way, for example, it may be provided that the heat exchange chamber of the casting mold unit comprises a fluid supply connection for supplying the fluid and the casting inlet unit comprises a fluid outlet connection for removing the fluid from the die casting device. The fluid supplied through the fluid supply connection accordingly flows first through the casting mold unit, and subsequently through the casting delivery unit and then through the casting inlet unit, and then emerges from the die casting device through the fluid outlet connection. As an alternative, it is of course possible to provide that the heat exchange chambers of the casting mold unit, of the casting delivery unit and/or of the casting inlet unit respectively comprise mutually separate fluid connections.

Lastly, it is provided that the heat exchange chambers of the casting mold unit, of the casting delivery unit and/or of the casting inlet unit are connected to at least one common fluid connection. In this way, as already mentioned above, it is possible to supply the fluid simultaneously both to the casting mold unit and to the casting delivery unit, as well as to the casting inlet unit, without having to provide separate respective fluid connections. In this way, the construction outlay for the die casting device, or the respective die casting mold part, can be reduced.

Likewise, the casting mold unit, casting delivery unit and casting inlet unit may be regulated or driven individually.

BRIEF DESCRIPTION OF THE DRAWINGS

The invention will be explained in more detail below with the aid of the exemplary embodiments represented in the drawing, without the invention being restricted.

DETAILED DESCRIPTION

Figure 1:
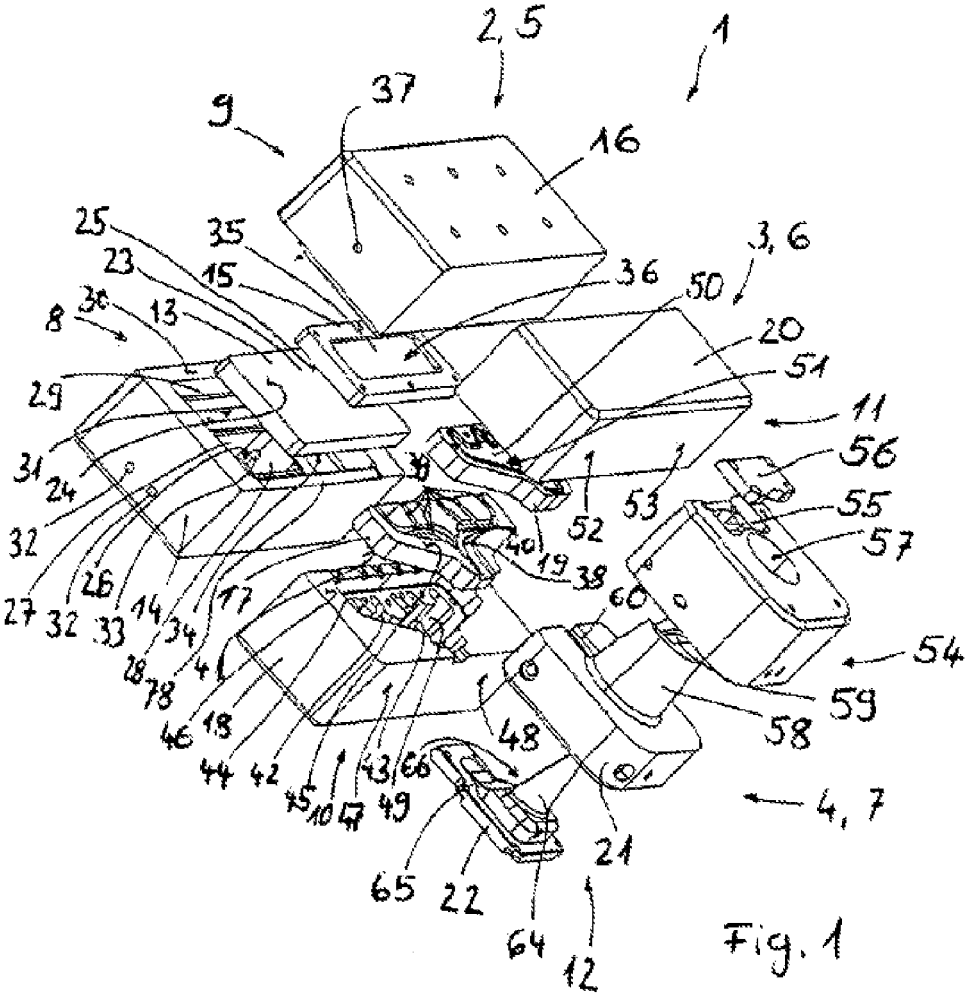
FIG. 1 shows an exploded representation of a die casting device having a casting mold unit, a casting delivery unit and a casting inlet unit, these respectively comprising a die casting mold consisting of two die casting mold parts.

FIG. 1 shows a die casting device 1, for example a die casting machine or a part thereof. The die casting device 1 is used for producing one or more die-cast components (not represented). It comprises a casting mold unit 2, a casting delivery unit 3 and a casting inlet unit 4. The casting mold unit 2 consists of a first die casting mold 5, the casting delivery unit 3 consists of a second die casting mold 6 and the casting inlet unit 4 consists of a third die casting mold 7. The first die casting mold 5 is composed of two die casting mold parts 8 and 9 and the second die casting mold is composed of die casting mold parts 10 and 11. The third die casting mold 7 consists of a die casting mold part 12. The die casting mold part 8 comprises a first component 13 and a second component 14. In a similar way to this, first components 15, 17, 19 and 21 and second components 16, 18, 20 and 22 are associated with the die casting mold parts 9 to 12.

The die casting mold parts 8 and 9 of the casting mold unit 2 will first be discussed in more detail below. The casting mold unit 2 comprises a casting mold 23, which is present at least locally between pressure zones 24 and 25 of the first components 13 and 15. The casting mold 23 essentially has a cavity having a shape which replicates a negative of a die-cast component to be produced. In a casting process carried out with the die casting device 1, casting material, or melt, is accordingly introduced into the casting mold 23 between the pressure zones 24 and 25 and, after cooling and solidification of the melt, the die-cast component is removed from the casting mold 23. To this end, the die casting mold part 8 and/or the die casting mold part 9 can be moved in the vertical direction away from the other respective die casting mold part 9 or 8. To this end, a corresponding movement device is accordingly provided.

Essentially, the die casting mold parts 8 and 9 are constructed similarly, so that only the die casting mold part 8 will be discussed initially and only the differences from the die casting mold part 9 will be indicated. The second component 14 of the die casting mold part 8 comprises a fluid guide recess 26, which completely forms a heat exchange chamber 27 of the die casting mold part 8. The first component 13 is for this reason formed flatly, or in the shape of a plate, and is arranged on the second component 14 in such a way that it closes the heat exchange chamber 27, or the fluid guide recess 26. The fluid guide recess 26 is in this case formed in the manner of a trough in the second component 14. This means that the second component 14 closes the fluid guide recess 26 with the exception of the opening 28 facing in the direction of the first component 13.

In order to receive the first component 13, the second component 14 comprises a compartment 29 which is formed in such a way that the second component 14 can fully receive the first component 13. The pressure zone 24 of the first component 13 in this case lies essentially on a plane having sealing surfaces 30, which cooperate with corresponding sealing surfaces (not represented here) of the die casting mold part 9, in order to seal the casting mold 23 from an environment of the die casting device 1 during the casting process. In the compartment 29, a bearing surface 31 is provided which is formed as a circumferential bearing web and is used to support the first component 13 in the compartment 29.

Two fluid inlet connections 32 and two fluid outlet connections 33 open into the heat exchange chamber 27, only one of the latter being visible. The fluid inlet connections 32 and the fluid outlet connections 33 engage as fluid inlet lines and fluid outlet lines, respectively, through the walls delimiting the heat exchange chamber 27, in order to allow the heat exchange chamber 27 to be supplied with a fluid. In this case, the fluid may be supplied through the fluid inlet connections 32 to the heat exchange chamber 27 and discharged through the fluid outlet connections 33. The association represented here is to be interpreted as purely exemplary. Thus, the fluid inlet connections 32 and the fluid outlet connections 33 may respectively be interchanged so that the fluid can flow through the heat exchange chamber 27 in different directions. Arranged opposite the pressure zone 24, there is a heat transfer surface 34 over which the fluid present in the heat exchange chamber 27 flows. The heat transfer surface 34 in this case belongs to a wall of the heat exchange chamber 27, preferably the same wall as the pressure zone 24.

The die casting mold part 9 arranged directly opposite the die casting mold part 8 differs from the first essentially in that the first component 15 in this case has a recess 35 which at least locally jointly forms a heat exchange chamber 36 of the die casting mold part 9. Furthermore, the second component 16 of the die casting mold part 9 has merely one fluid inlet connection 37.

The comments made above for the die casting mold parts 8 and 9 can essentially be applied to the die casting mold parts 10 and 11. Nevertheless, the latter will be discussed briefly below. The die casting mold parts 10 and 11 are a component of the casting delivery unit 3, in which a casting delivery region 38 exists, or is delimited by the first components 17 and 19. The casting delivery region 38 is in this case present in flow channels 39 (here indicated merely for the first component 17) incorporated into the first components 17 and 19. In the flow channels 39, there is also a pressure zone 40 of the casting delivery unit 3.

Opposite the pressure zone 40, a heat transfer surface 41 is provided on the first component 17. If the first component 17 is arranged in a compartment 42 provided therefor in the second component 18, the heat transfer surface 41 together with the second component 18 delimits a heat exchange chamber 43 of the die casting mold part 10. In the recess 42, a bearing surface 44 is provided which is formed as a circumferential bearing web. The recess 42 is in this case formed in such a way that the second component 18 can fully receive the first component 17, so that sealing surfaces 45 of the first component 17 lie flush with sealing surfaces 46 of the second component 18 and cooperate with sealing surfaces (not represented here) of the first component 19 and of the second component 20 in order to seal the casting delivery region 38 from an environment of the die casting device 1.

In the second component 18, at least one fluid inlet connection 47 and one fluid outlet connection 48 are provided, which open into the heat exchange chamber 43. The heat exchange chamber 43 is also formed as a fluid guide recess 49 in this case.

The die casting mold part 11 provided directly opposite the die casting mold part 10 is constructed in a similar way thereto. To this extent, the comments made for the die casting mold part 10 are readily applicable to the die casting mold part 11 and vice versa. FIG. 1 shows that the first component 19 of the die casting mold part 11 comprises a recess 50. If the first component 19 is arranged in the second component 20, then this recess 50 serves to jointly form a heat exchange chamber 51. In a similar way to the second component 18 of the die casting mold part 10, the second component 20 respectively comprises a fluid inlet connection 52 and a fluid outlet connection 53.

FIG. 1 furthermore shows the casting inlet unit 4 having the third die casting mold 7. Associated with the casting inlet unit 4, there is a cooling ring 54 which comprises a heat exchange chamber 55 that can be closed by a closure plate 56. The cooling ring 24 in this case comprises a central opening 57, into which a casting material extension 58 of the first component 21 of the die casting mold part 12 engages. On the casting material extension 58, a flow channel is formed as a casting inlet 59 which also extends over further regions of the first component 21 as far as the casting delivery unit 3. Molten casting material (melt) can flow along this casting inlet 59 in order to enter the casting mold unit 2 through the casting delivery unit 3. In the flow channel 59, there is to this extent likewise a pressure zone 60. The latter lies, relative to a wall of the first component 21, opposite a heat transfer surface 61 (which cannot be seen here). This heat transfer surface 61 is present in a heat exchange chamber 62, which is formed by a recess 63 of the first component 21.

The heat exchange chamber 62 is open in the direction of the second component 22. The second component 22 is in this case used to close the heat exchange chamber 62, or the recess 63. The second component 22 comprises a fluid guide projection 64, which extends into the heat exchange chamber 62. The fluid guide projection 64 forms a flow contour surface 65 of the second component 22. The flow contour surface 65 is in this case a non-planar surface contour and comprises a concave region 66. The concave region 66 is in this case jointly formed by the fluid guide projection 64. Both a fluid inlet connection 67 and a fluid outlet connection 68 are connected to the heat exchange chamber 62 of the die casting mold part 12. This, however, cannot be seen in FIG. 1.

The die casting device 1 represented in FIG. 1 is used for producing die-cast components from a casting material, which is present in the form of the melt. In order to produce the die-cast component, the die casting mold parts 8 and 10 and the die casting mold parts 9 and 11 are moved toward one another so that the casting mold 23, or the casting delivery region 38, are sealed. The pressurized melt is subsequently supplied through the opening 57 to the casting inlet unit 4, then runs along the casting inlet 59 in the direction of the casting delivery unit 3 and flows into its casting delivery region 38, or the flow channels 39. The flow channels 39 ensure distribution of the flow of melt, so that the melt can be supplied to the casting mold 23 at different positions as seen in the lateral direction. Melt is supplied to the casting delivery unit 4 until the casting mold 23 is filled.

The melt is subsequently cooled, to which end fluid is introduced into the heat exchange chambers 27, 36, 43, 51, 55 and 62. The temperature of the fluid, or its mass flow rate, is selected in such a way that there is an optimal cooling characteristic of the die-cast component. To this end, in particular, it is necessary to cool the latter as uniformly as possible, in order to ensure sufficiently high stability of the die-cast component. A further aim is maximally rapid cooling, in order to achieve a high throughput of the die-cast components and therefore lower production costs.

After solidification, or cooling, of the melt, the die casting mold parts 8 and 10 and the die casting mold parts 9 and 11 are respectively moved away from one another, so that the casting mold 23 and the casting delivery region 38 are released. Likewise, the cooling ring 54 is removed from the casting inlet unit 4. Subsequently, the produced die-cast component can be removed, together with the sprue remaining in the casting delivery region 38 and the casting material remaining in the region of the casting inlet unit 4, from the die casting device 1. In the scope of finishing work, the sprue is removed from the die-cast component and preferably re-melted.

Figure 2:
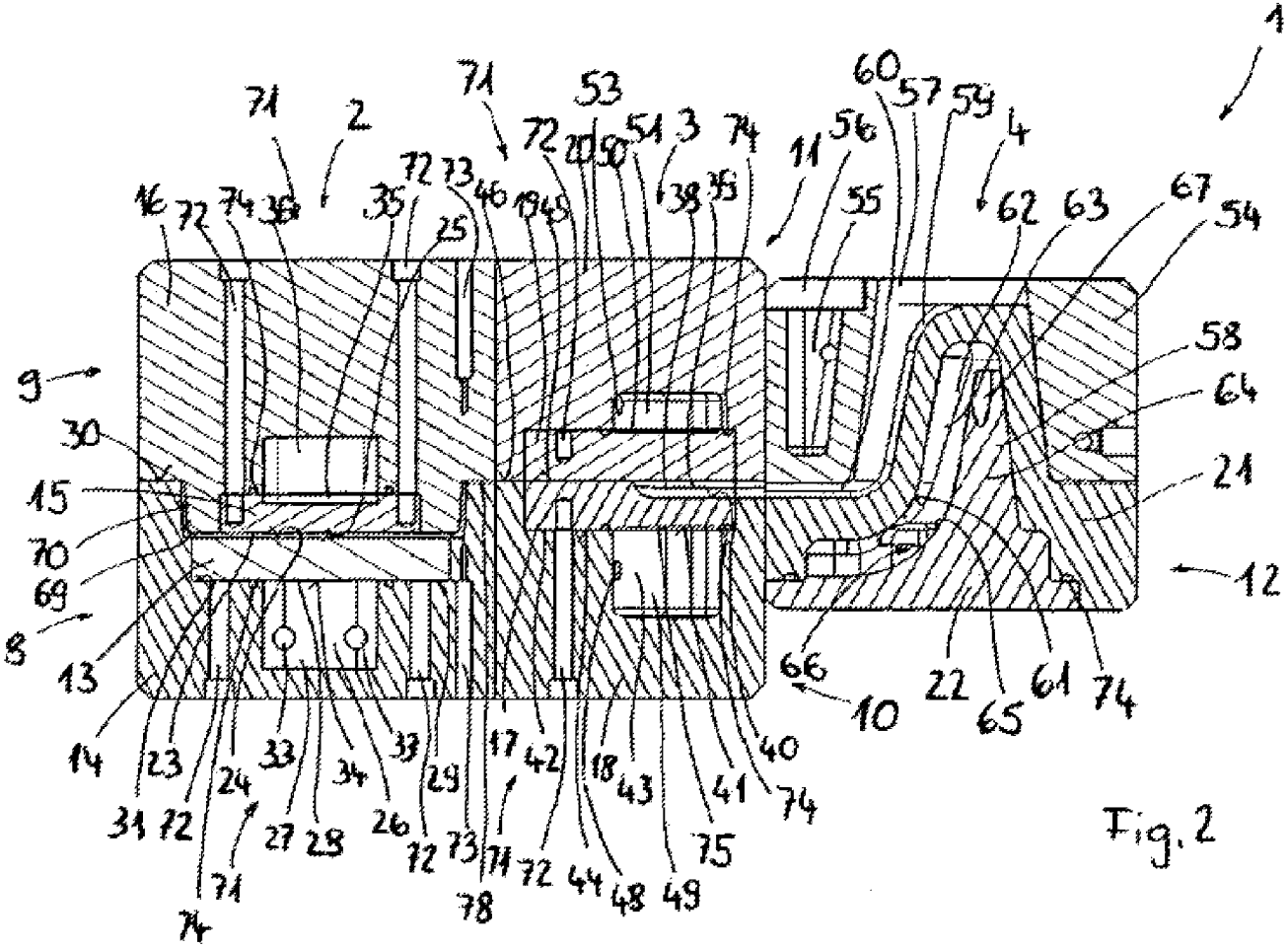
FIG. 2 shows a lateral sectional representation of the die casting device.

FIG. 2 shows a sectional view of the die casting device 1, an arrangement of the die casting mold parts 8 to 12 which exists during the casting process being shown. The die casting mold parts 8 and 9 and the die casting mold parts 10 and 11 thus lie closely next to one another. It is clear that the casting mold 23 is delimited not merely by the pressure zone 24 of the die casting mold part 8 and a pressure zone (not denoted in detail) of the die casting mold part 9, but that the second components 14 and 16 each comprise a pressure region 69 and 70, respectively, which jointly define the casting mold 23. In this case, the pressure region 69 ends essentially flatly with the pressure zone 24 and the pressure region 70 with the pressure zone 25 of the first component 15 of the die casting mold part 9. It can again be seen that the first components 13 and 15 are respectively received fully in the second components 14 and 16, to which end the compartment 29 is provided in the case of the die casting mold part 8.

It can furthermore be seen that the components 13 and 14, 15 and 16, 17 and 18, as well as 19 and 20, are respectively held together by means of a screw connection 71. Each screw connection 71 in this case comprises at least one screw 72. It can also be seen that a sensor compartment 73, in which a temperature sensor (not represented here) can be arranged, is respectively provided in the second components 14 and 16. By means of this temperature sensor, the temperature of the second components 14 and 16, or at least approximately the temperature of the pressure zones 24 and 25, can be determined. On the basis of this determined temperature, the temperature of the fluid or its mass flow rate is subsequently adjusted in a controlling and/or regulating manner. In this way, the melt present in the die casting device 1 can be cooled rapidly and in a controlled way to a particular temperature. Between the components 13 and 14, 15 and 16, 17 and 18, 19 and 20 as well as 21 and 22, a seal 74 is respectively provided which encloses the entire respectively associated heat exchange chamber 27, 36, 43, 51 or 62. A high fluid pressure can therefore respectively be applied in the heat exchange chambers 27, 36, 43, 51 and 62, without the fluid being able to escape unintentionally therefrom.

FIG. 2 again makes it clear that the heat exchange chamber 27 of the die casting mold part 8 may be formed merely by the fluid guide recess 26 of the second component 14. Conversely, the heat exchange chambers 36, 43 are respectively formed jointly by the recesses 35 and 50 of the first components 15 and 19 as well as a recess 75 of the first component 17. It is clear, however, that the die casting mold parts 8, 9, 10 and 11 are essentially constructed similarly, while the die casting mold part 12 has a structurally different construction. In the latter, as already described above, the fluid guide projection 24 extends into the heat exchange chamber 62 which is formed by the recess 63 in the first component 21. In this case, it is furthermore provided that the contour of the heat transfer surface 61 is at least locally adapted to the contour of the pressure zone 60. The flow contour surface partially extends with respect to the heat transfer surface 61 in such a way that an approximately consistently large flow cross section for the fluid is formed at least zonally.

Figure 3:
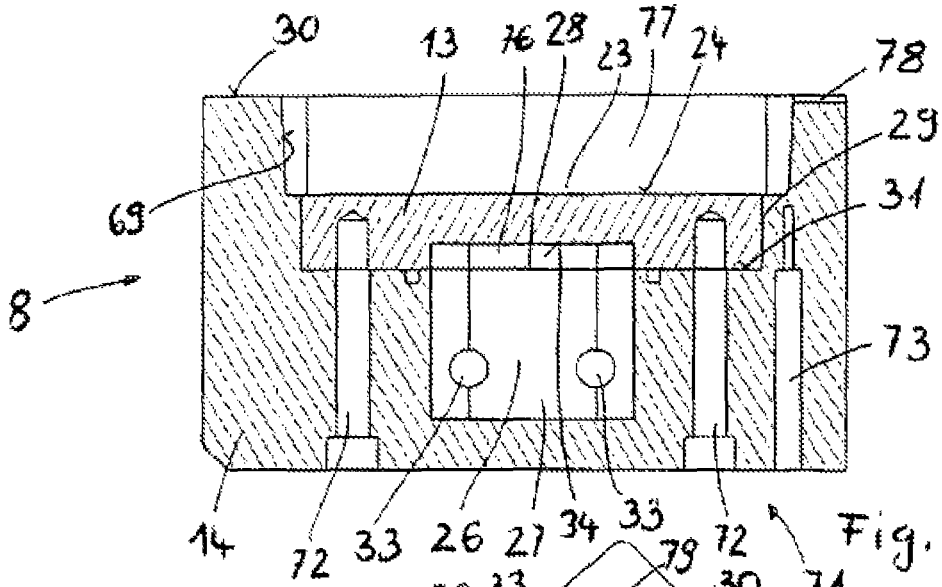
FIG. 3 shows one of the die casting mold parts of the casting mold unit, the die casting mold part comprising a first component and a second component, in a view which shows a vertical section of the die casting mold part.

FIG. 3 shows the die casting mold part 8 in a sectional representation. In this case, unlike the die casting mold part 8 represented in FIG. 2, the heat exchange chamber 27 is formed together both by the fluid guide recess 26 of the second component 14 and by a recess 76 of the first component 13. The recess 76 and the fluid guide recess 26 are accordingly in flow connection with one another, in order to form the heat exchange chamber 27. In this case, they have the same dimensions in the lateral direction, so that side walls of the fluid guide recess 26 and of the recess 76 lie flush with one another. A casting mold compartment 77 can likewise be seen, which is delimited by the pressure zone 24 and the pressure zone 69. In order to carry out the casting process, the die casting mold part 9 is at least locally received in this casting mold compartment 77 in order to form the casting mold 23.

In order to make it possible to fill the casting mold 23, a feed 78 is formed in the second component 14. Via this feed 78, a flow connection can be established to the flow channels 39, or in the casting delivery region 38 of the casting delivery unit 3. The feed 78 is present even when the sealing surface 30 cooperates with a corresponding sealing surface of the die casting mold part 9 in such a way that the casting mold 23 is sealed from an environment of the die casting device 1.

Figure 4:
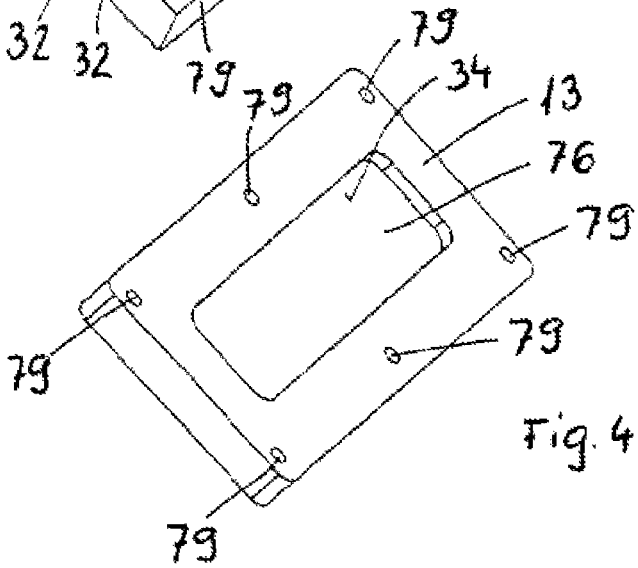
FIG. 4 shows the first component of the die casting mold part according to FIG. 3.

FIG. 4 shows the first component 13. In this case, it is clear that the recess 76 is present in the manner of a trough therein.

Figure 5:
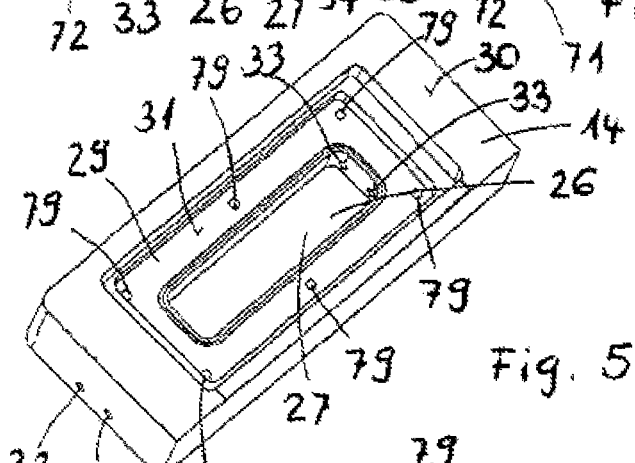
FIG. 5 shows the second component of the die casting mold part according to FIG. 3.

FIG. 5 shows the second component 14. It can be seen that the fluid guide recess 26 has smaller dimensions in the lateral direction than the compartment 29, in order to form the bearing surface 31. In FIGS. 4 and 5, bores 79 can be seen which are provided in order to receive the screws 72. It is accordingly clear that six screws 72 are provided in order to fasten the first component 13 on the second component 14.

Figure 6:
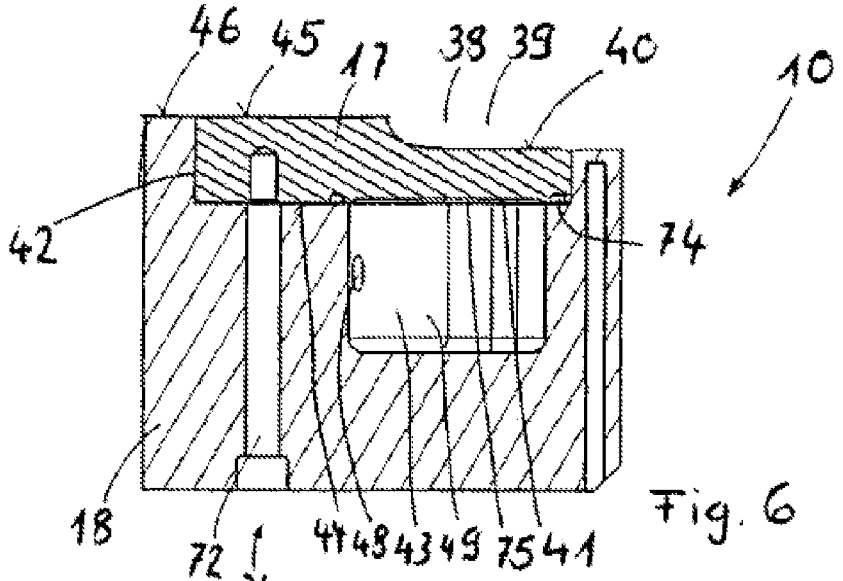
FIG. 6 shows one of the die casting mold parts of the casting delivery unit, having a first component and a second component, in a view which shows a vertical section of the die casting mold part.

FIG. 6 shows a sectional view of the die casting mold part 10, with its first component 17 and the second component 18. The die casting mold part 10 is formed in the known way. In this regard, reference is made to the embodiments above.

Figure 7:
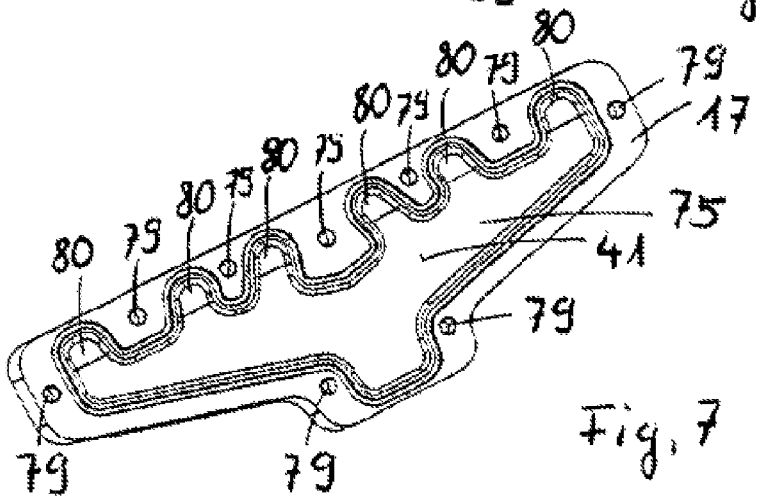
FIG. 7 shows the first component of the die casting mold part according to FIG. 6.

FIG. 7 shows the first component 17 of the die casting mold 10 in a view from below. It is therefore clear that the first component 17 comprises the recess 75. In this case, this recess 75 comprises tongues 80, which essentially extend below the flow channels 39 in order to sufficiently cool the pressure zone 40 located therein, by virtue of the fact that the heat transfer surface 41 is also present in this region and fluid can flow over it. Each of the tongues 80 accordingly corresponds to one of the flow channels 39.

Figure 8:
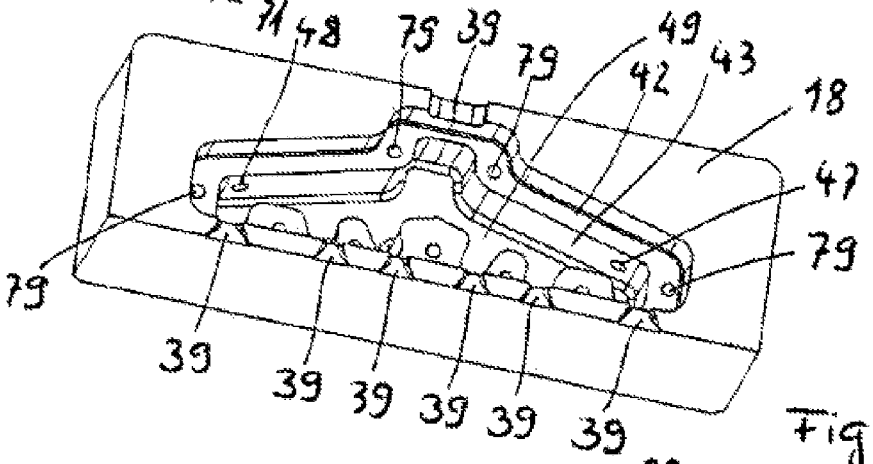
FIG. 8 shows the second component of the die casting mold part according to FIG. 6.

FIG. 8 shows the second component 18 of the die casting mold part 10. The first component 17 described above is in this case formed as an insertion component for the compartment 42. It is clear that, in the case of the die casting mold part 10 of the casting delivery unit 3, the second component 18 comprises a region of the flow channels 39, and thus forms them together with the first component 17. The embodiment shown here corresponds to that already known, so that in turn reference is made to the embodiments above.

Figure 9:
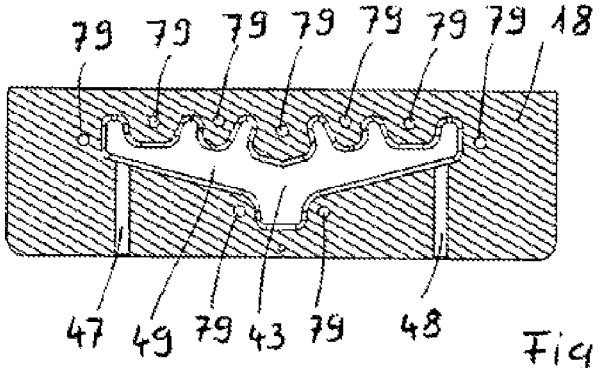
FIG. 9 shows the second component of the die casting mold part in a view which shows a horizontal section in a plane in which fluid lines of the second component extend.

FIG. 9 shows a sectional view of the second component 18. In addition to that described above, it is clear that the fluid inlet connection 47 and the fluid outlet connection 48 are respectively formed as a fluid inlet line and a fluid outlet line. Here again, reference should be made to the embodiments above.

Figure 10:
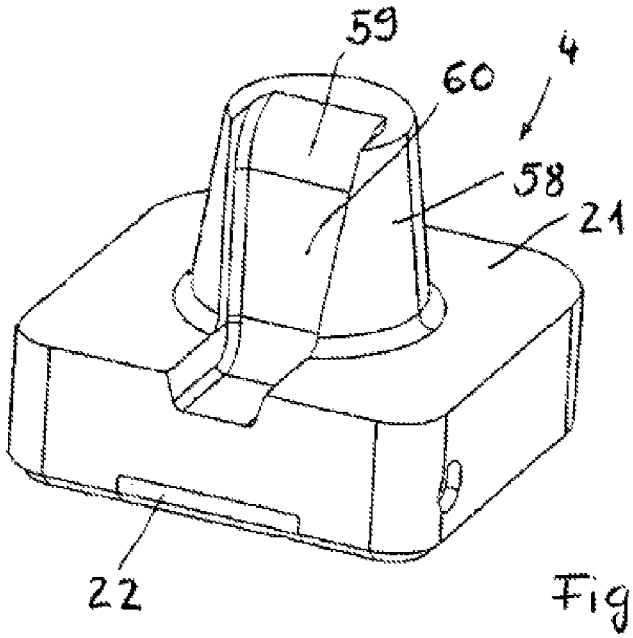
FIG. 10 shows a die casting mold part of the casting inlet unit, having a first component and a second component.

FIG. 10 shows the casting inlet unit 4, consisting of the first component 21 and the second component 22. The first component 21 comprises the casting material extension 58, in which the casting inlet 59 and the pressure zone 60 are locally present. Both, however, continue in a bottom region of the first component 21 in the direction of the casting delivery unit 3.

Figure 11:
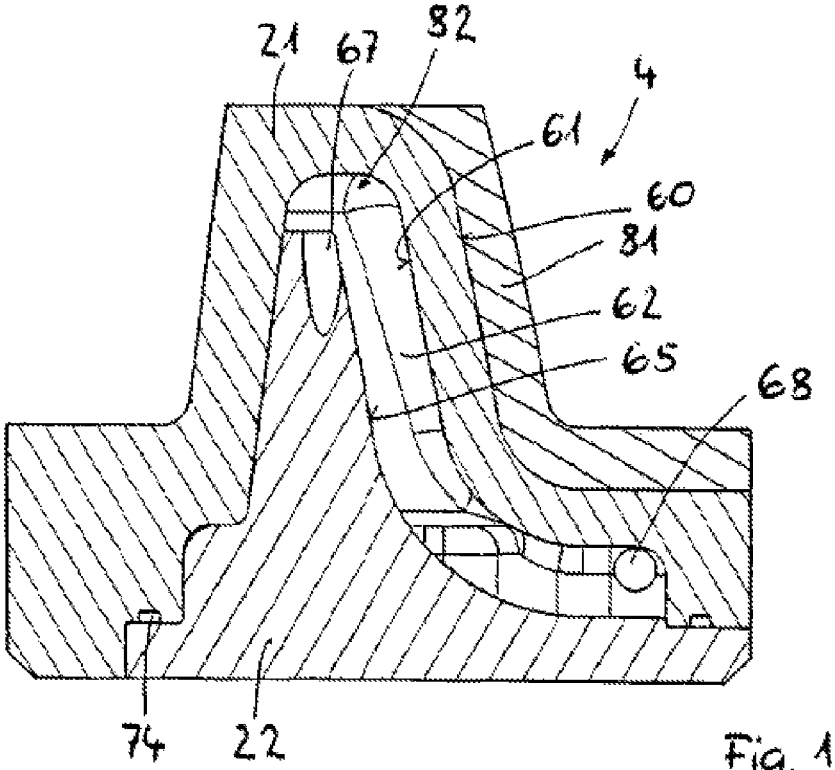
FIG. 11 shows the die casting mold part of the casting inlet unit in a sectional view which shows a horizontal section.

FIG. 11 shows a sectional view of the casting inlet unit 4, consisting of the first component 21 and the second component 22. In order to clarify the structure of the casting inlet unit 4, a flow 81 of the melt is represented. This is present in the region of the pressure zone 60. In relation to the wall associated with the pressure region 60, the heat transfer surface 61 lies opposite thereto. The latter delimits the heat exchange chamber 62, which corresponds with the fluid inlet connection 67 and the fluid outlet connection 68. Fluid flowing in through the fluid inlet connection 67 therefore flows through the heat exchange chamber 62 as far as the fluid outlet connection 68. In this case, the heat transfer surface 61 and therefore also the pressure zone 60 are cooled by the fluid.

It will be indicated here that there is also one of the seals 74 between the first component 21 and the second component 22. The fluid inlet connection 67 is formed in such a way that fluid flowing out of it into the heat exchange chamber 62 first encounters a deviating region 82, which is formed by the wall of the first component 21 at the highest point of the heat exchange chamber 62. The deviating region 82 causes deviation of the fluid, so that the latter flows in the direction of the fluid outlet connection 68.

FIG. 11 makes it clear that the flow contour surface 65 of the second component extends with respect to the heat transfer surface 61 in such a way that there is an essentially constant flow cross section for the fluid. To this end, the flow contour surface 65 extends at least locally parallel to the heat transfer surface 61. The second component 22 is arranged on the first component 21 in such a way that it closes the heat exchange chamber 62. To this end, the heat exchange chamber 62 is provided with an opening on the opposite side of the first component 21 from the pressure zone 60, and the second component 22 is arranged for closure thereof in this opening.

Figure 12:
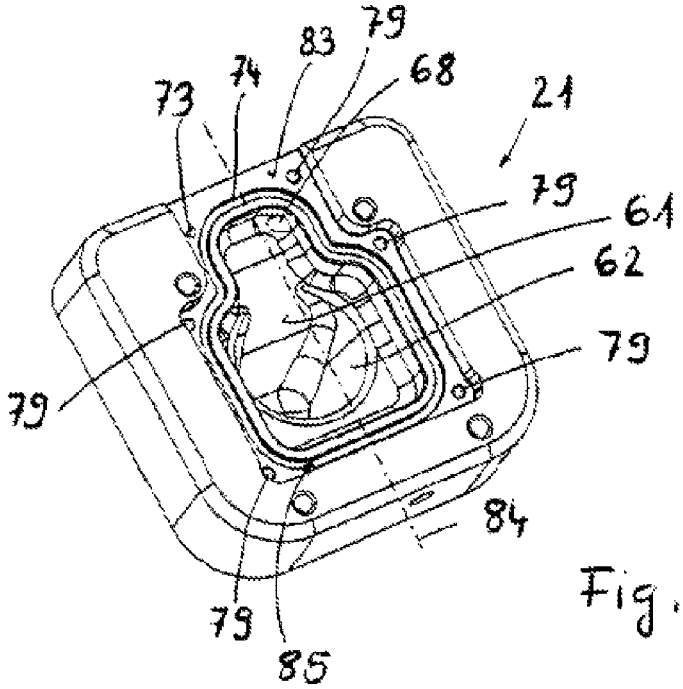
FIG. 12 shows a view of the first component of the die casting mold part known from FIGS. 10 and 11 from below, a heat exchange chamber formed in the first component being open.

FIG. 12 shows a view of the first component 21 from below. Because the second component 22 is not represented, a view through the opening into the heat exchange chamber 62 is possible. It is clear that the first component 21 in this case provides a bearing surface 83 for the second component 22. The seal 74, which is arranged between the first component 21 and the second component 22 in order to seal the heat exchange chamber 62, is also present in the bearing surface 83.

Besides the bores 79 which are arranged for establishing the screw connection 71 between the components 21 and 22, FIG. 12 also shows a further sensor compartment 73. A temperature sensor may be arranged therein in order to determine the temperature of the first component 21, or of the casting inlet unit 4, at least approximately.

It can also be seen in FIG. 12 that the heat transfer surface 61 has a three-dimensional contour. In this case, the profile of the heat transfer surface 61, which is shown as being concave in FIG. 11, is present merely in a vertical section surface (starting from the line 84). In the lateral direction, which lies perpendicularly to the section plane, there may be a profile of the heat transfer surface 61 differing from this concave profile. The heat transfer surface 61 is in this case preferably contoured in such a way that maximally uniform cooling of the melt takes place owing to the fluid located in the heat exchange chamber 62. In principle, however, the heat transfer surface 61 may be configured arbitrarily and, for example, also formed in such a way as to ensure the simplest possible producibility of the first component 21.

Figure 13:
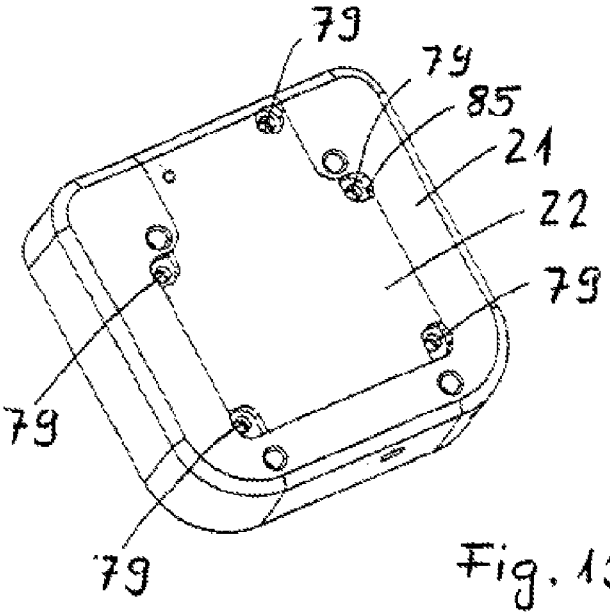
FIG. 13 shows the die casting mold part of the casting inlet unit in a view from below, the heat exchange chamber of the first component being closed by means of the second component.

FIG. 13 shows a view of the first component 21 from below, the opening of the heat exchange chamber 62 (which cannot be seen here) being closed by the second component 22. A compartment 85, which the first component 21 comprises for the second component 22, may be fully filled by the second component 22, although it does not have to be. In the example represented, the second component 22 comprises indentations in the region of a part of the bores 79, so that the compartment 85 is not fully filled by the second component 22. It is, however, advantageous for the compartment 85 to be configured in principle in such a way that the second component 22 is fully received in the compartment 85 at least in the vertical direction. This means that a depth of the compartment 85 essentially corresponds to a wall thickness of the second component 22 in the region of the bearing surface 83, so that the components 21 and 22 form an essentially planar surface with their bottom surfaces.

Figure 14:
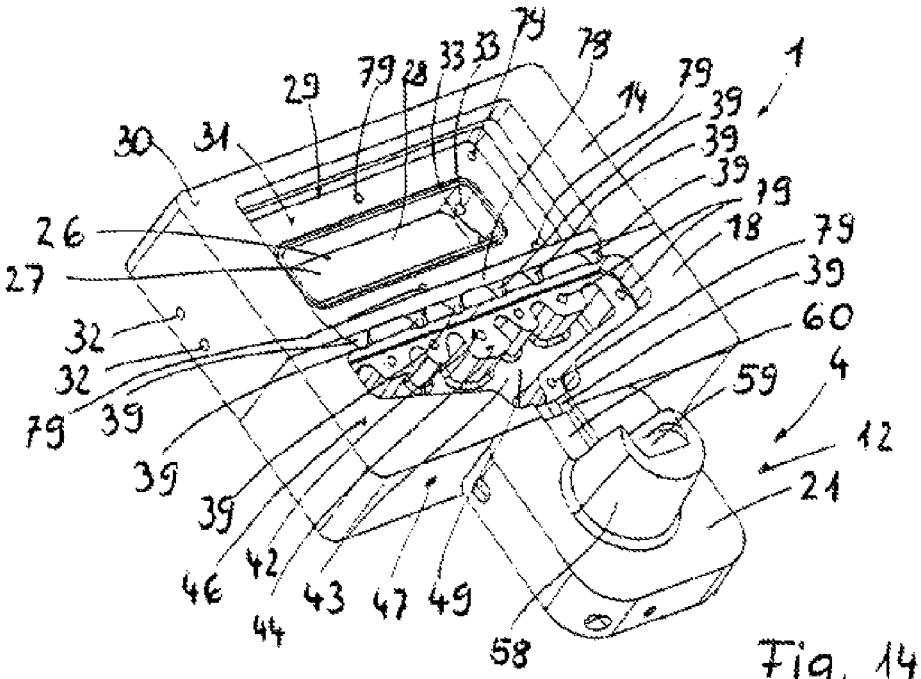
FIG. 14 shows a view of the die casting mold parts of a casting mold unit, casting delivery unit and casting inlet unit, only the second component of the die casting mold part respectively being represented for the casting mold unit and the casting delivery unit.

FIG. 14 shows a view of the die casting device 1, only the second component 14 and the second component 18 being represented together with the casting inlet unit 4. Here, it is again clear that the casting inlet 59 of the casting inlet unit 4 is in flow connection with a region of the flow channels 39 which is formed by the second component 18. The same applies for flow channels 39 lying opposite in the flow direction and the feed 78 of the second component 14. The components 14 and 18 represented, and the casting inlet unit 4, correspond essentially to the known embodiments, so that in this regard reference is made to the embodiments above.

Figure 15:
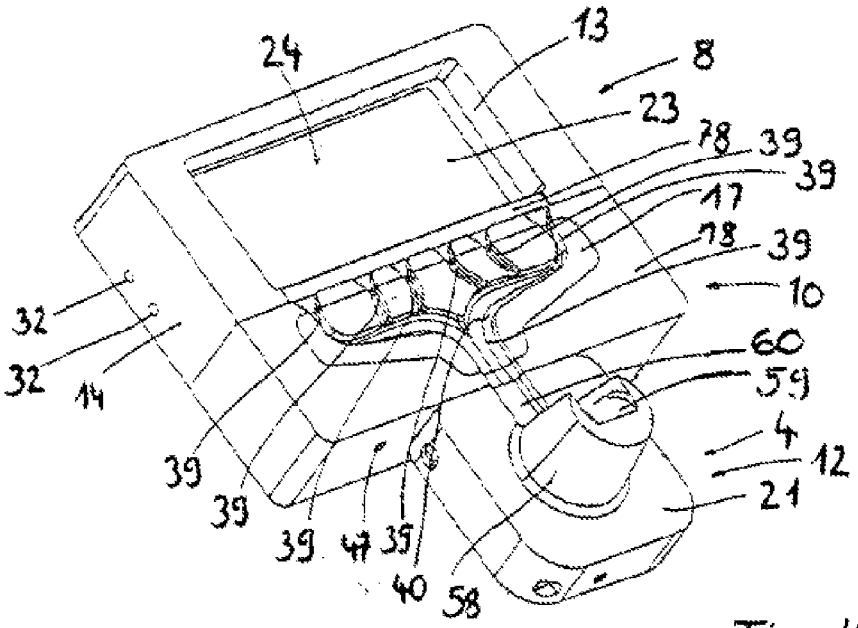
FIG. 15 shows the die casting device known from FIG. 14, the first component of the casting mold unit and of the casting delivery unit being inserted into the respectively associated second component, and/or vice versa.

FIG. 15 shows the arrangement known from FIG. 14, the first component 13 now being inserted into the second component 14 and the first component 17 into the second component 18. The die casting mold parts 8 and 10 are thus essentially complete. There is therefore a flow connection between the casting inlet unit 4, or the casting inlet 59, and the casting mold 23, because the components 17 and 18 together form the flow channels 39 and thus establish a connection between the casting inlet 59 and the feed 78, and consequently to the casting mold 23. Here again, reference should be made to the embodiments above for a more detailed description of the individual elements.

It should again be pointed out that at least the die casting mold parts 8, 9, 10 and 11 are respectively constructed similarly, so that the properties respectively established above for these elements are for the most part applicable to every other of these elements.

With the die casting device 1 proposed here, or the die casting mold parts 8 to 12, it is possible to achieve good flow through the heat exchange chambers 27, 36, 43, 51 and 62, and therefore high heat exchange, or good cooling, of the casting mold 23, of the casting delivery region 38 and of the casting inlet 59. In this way, the solidification time of the die-cast component to be produced can be reduced and, at the same time, homogeneous cooling thereof can be achieved. In the regions to be called, there is accordingly an essentially homogeneous temperature pattern at any time. Particularly in the region of the casting mold 23, an FEM method is used for the configuration of the die casting mold parts 8 and 9.

The fluid used for the cooling may be either gaseous or liquid. By expedient configuration of the heat exchange chambers 27, 36, 51, 55 and 62, the effectiveness of the temperature control, or cooling, can be increased. To this end, for example, fluid guide projections in the sense of the die casting mold part 12, which extend into the respective heat exchange chamber 27, 36, 43, 51 or 55, are also provided in the die casting mold parts 8, 9, 10 and 11. Such fluid guide projections to this extent serve as turbulators, in order to generate turbulence and therefore increase the heat transfer.

The invention claimed is:

1. A die casting mold part of a die casting mold, comprising a first component comprising a pressure zone fixed along a mold cavity having a shape replicating a negative of a part to be die cast, a second component and a heat exchange chamber which is formed by the components and through which a fluid can flow, for controlling the temperature of the pressure zone, the first component having a heat transfer surface which belongs to at least one wall of the heat exchange chamber and is thermally associated with the pressure zone, wherein a fluid guide recess which is open in the direction of the first component is formed in the manner of a trough in the second component, wherein the fluid guide recess forms a portion of the heat exchange chamber, wherein the first component is formed in the shape of a plate and is arranged on the second component in such a way that it closes the heat exchange chamber, and wherein the heat exchange chamber is fluidically connected to at least one fluid connection formed as a fluid line and the fluid line is at least locally provided in the second component, and the heat exchange chamber has at least one inlet formed in the second component and at least one outlet formed in the second component said at least one inlet and said at least one outlet being along the trough below the first component.

2. The die casting mold part as claimed in claim 1, wherein a recess of the first component forms at least in part the heat exchange chamber.

3. The die casting mold part as claimed in claim 1, wherein a flow contour surface comprises at least one convex and/or concave region jointly formed by a fluid guide projection and/or the fluid guide recess.

4. The die casting mold part as claimed in claim 1, wherein a contour of the heat transfer surface at least locally is approximated to a three-dimensional contour of the pressure zone.

5. The die casting mold part as claimed in claim 1, wherein the first component or the second component comprises a compartment into which the second component or the first component is inserted at least in part.

6. The die casting mold part as claimed in claim 1, wherein the pressure zone of the first component delimits at least a part of a casting mold for a die-cast component, of a casting delivery region and/or of a casting inlet.

7. The die casting mold part as claimed in claim 6, wherein a pressure region of the second component jointly delimits the casting mold, the casting delivery region and/or the casting inlet.

8. The die casting mold part as claimed in claim 6, wherein the heat exchange chamber is shaped to a profile of at least one flow channel associated with the casting mold, the casting delivery region and/or the casting inlet.

9. The die casting mold part as claimed in claim 1, wherein the first component is releasably connected to the second component by a screw connection.

10. The die casting mold part as claimed in claim 1, wherein the first and/or the second component comprises at least one sensor compartment for a temperature sensor.

11. The die casting mold part as claimed in claim 1, wherein a seal sealing the heat exchange chamber is provided between the first component and the second component.

12. The die casting mold part as claimed in claim 1 wherein:

the die casting mold part is a first die casting mold part; and the die casting device further comprises a second die casting mold part cooperating with the first die casting mold part to form the mold cavity.

13. The die casting mold part as claimed in claim 1, wherein the heat exchange chamber is a single chamber having said inlet among a plurality of inlets formed in the second component and said outlet among a plurality of outlets formed in the second component.

14. A die casting device comprising a die casting mold part, the die casting mold part being part of a die casting mold and having a first component comprising a fixed pressure zone, a second component and a heat exchange chamber which is formed by the components and through which a fluid can flow, for controlling the temperature of the pressure zone, the first component having a heat transfer surface which belongs to at least one wall of the heat exchange chamber and is thermally associated with the pressure zone, wherein a fluid guide recess which is open in the direction of the first component is formed in the manner of a trough in the second component, wherein the fluid guide recess forms a portion of the heat exchange chamber, wherein the first component is formed in the shape of a plate and is arranged on the second component in such a way that it closes the heat exchange chamber, and wherein the heat exchange chamber is fluidically connected to at least one fluid connection formed as a fluid line and the fluid line is at least locally provided in the second component, the trough being a portion of a compartment in the second component the compartment having a bearing surface circumscribing the trough and supporting the first component in the compartment, the fluid line opening to the trough.

15. The die casting device as claimed in claim 14, comprising:

a casting mold unit having a casting mold cavity;

a casting delivery unit; and a casting inlet unit, the casting mold unit comprising a casting mold, the casting delivery unit comprising a casting delivery region and the casting inlet unit comprising a casting inlet and wherein the die casting mold part is a die casting mold part of one of said casting mold unit, casting delivery unit, and casting inlet unit.

16. The die casting device as claimed in claim 15, wherein the casting mold, the casting delivery region and the casting inlet are fluidically connected to one another in order for a casting material to flow through.

17. The die casting device as claimed in claim 15, wherein the heat exchange chamber comprises:

a heat exchange chamber of the casting mold unit, a heat exchange chamber of the casting delivery unit and a heat exchange chamber of the casting inlet unit fluidically connected to one another in order for the fluid to flow through by way of at least one passage.

18. The die casting device as claimed in claim 17, wherein a flow path for metal proceeds sequentially through the casting inlet unit, the casting delivery unit, and into the casting mold unit.

19. The die casting device as claimed in claim 15, wherein the heat exchange chamber comprises:

a heat exchange chamber of the casting mold unit, a heat exchange chamber of the casting delivery unit and a heat exchange chamber of the casting inlet unit connected to at least one common fluid connection.

20. The die casting device as claimed in claim 14, wherein:

the die casting mold part is a first die casting mold part; and the die casting device further comprises a second die casting mold part cooperating with the first die casting mold part to form a mold cavity.

21. A die casting device comprising a die casting mold part, the die casting mold part being part of a die casting mold and having a first component comprising a pressure zone, a second component and a heat exchange chamber which is formed by the components and through which a fluid can flow, for controlling the temperature of the pressure zone, the first component having a heat transfer surface which belongs to at least one wall of the heat exchange chamber and is thermally associated with the pressure zone, wherein a fluid guide recess which is open in the direction of the first component is formed in the manner of a trough in the second component, wherein the fluid guide recess forms a portion of the heat exchange chamber, wherein the first component is formed in the shape of a plate and is arranged on the second component in such a way that it closes the heat exchange chamber, and wherein the heat exchange chamber is fluidically connected to at least one fluid connection formed as a fluid line and the fluid line is at least locally provided in the second component, wherein:

the die casting mold part is a first die casting mold part;

the die casting device further comprises a second die casting mold part cooperating with the first die casting mold part to form a mold cavity; and the second die casting mold part comprises:

a first component comprising a pressure zone facing the first die casting mold part first component pressure zone, a second component and a heat exchange chamber which is formed by the components and through which a fluid can flow, for controlling the temperature of the pressure zone, wherein:

the first component has a heat transfer surface which belongs to at least one wall of the heat exchange chamber and is thermally associated with the pressure zone;

the second component has a fluid guide recess which is formed in the manner of a trough and is open toward the first component and forms a portion of the heat exchange chamber;

a recess of the first component forms the heat exchange chamber together with the fluid guide recess;

the first component is formed in the shape of a plate and is arranged on the second component in such a way that it closes the heat exchange chamber; and the heat exchange chamber is fluidically connected to at least one first fluid connection formed as a fluid line and the fluid line is at least locally provided in the second component.

22. A die casting mold part of a die casting mold, comprising a first component comprising a pressure zone, a second component and a heat exchange chamber which is formed by the components and through which a fluid can flow, for controlling the temperature of the pressure zone, the first component having a heat transfer surface which belongs to at least one wall of the heat exchange chamber and is thermally associated with the pressure zone, wherein a fluid guide recess which is open in the direction of the first component is formed in the manner of a trough in the second component, wherein the fluid guide recess forms a portion of the heat exchange chamber, wherein the first component is formed in the shape of a plate and is arranged on the second component in such a way that it closes the heat exchange chamber, and wherein the heat exchange chamber is fluidically connected to at least one fluid connection formed as a fluid line and the fluid line is at least locally provided in the second component, wherein:

the die casting mold part is a first die casting mold part;

the die casting device further comprises a second die casting mold part cooperating with the first die casting mold part to form a mold cavity; and the second die casting mold part comprises:

a first component comprising a pressure zone facing the first die casting mold part first component pressure zone, a second component and a heat exchange chamber which is formed by the components and through which a fluid can flow, for controlling the temperature of the pressure zone, wherein:

the first component has a heat transfer surface which belongs to at least one wall of the heat exchange chamber and is thermally associated with the pressure zone;

the second component has a fluid guide recess which is formed in the manner of a trough and is open toward the first component and forms a portion of the heat exchange chamber;

a recess of the first component forms the heat exchange chamber together with the fluid guide recess;

the first component is formed in the shape of a plate and is arranged on the second component in such a way that it closes the heat exchange chamber; and the heat exchange chamber is fluidically connected to at least one first fluid connection formed as a fluid line and the fluid line is at least locally provided in the second component.

23. The die casting mold part as claimed in claim 22, wherein the heat exchange chamber is a single chamber having a plurality of inlets formed in the second component and a plurality of outlets formed in the second component.

24. The die casting mold part as claimed in claim 23, wherein:

the trough is a portion of a compartment in the second component the compartment having a bearing surface circumscribing the trough and supporting the first component in the compartment.

25. The die casting mold part as claimed in claim 24, wherein:

a sidewall of the trough is flush with a sidewall of the first component recess.

26. The die casting mold part as claimed in claim 22, wherein:

the trough is a portion of a compartment in the second component the compartment having a bearing surface circumscribing the trough and supporting the first component in the compartment.

27. The die casting mold part as claimed in claim 26, wherein:

a sidewall of the trough is flush with a sidewall of the first component recess.

* * * * *